US009562369B2

(12) United States Patent
Kuo

(10) Patent No.: US 9,562,369 B2
(45) Date of Patent: Feb. 7, 2017

(54) CODE-CHANGEABLE ASSEMBLY AND DIAL WHEEL DEVICE

(71) Applicant: Lambert Kuo, Tainan (TW)

(72) Inventor: Lambert Kuo, Tainan (TW)

( * ) Notice: Subject to any disclaimer, the term of this patent is extended or adjusted under 35 U.S.C. 154(b) by 217 days.

(21) Appl. No.: 14/510,241

(22) Filed: Oct. 9, 2014

(65) Prior Publication Data

US 2016/0102475 A1 Apr. 14, 2016

(51) Int. Cl.
*E05B 37/00* (2006.01)
*E05B 37/02* (2006.01)

(52) U.S. Cl.
CPC ..... *E05B 37/0048* (2013.01); *E05B 37/02* (2013.01); *E05B 37/0058* (2013.01)

(58) Field of Classification Search
CPC ..... E05B 37/0048; E05B 37/02; E05B 37/06; E05B 37/0058
USPC ..... 70/26, 30, 312, 315–318
See application file for complete search history.

(56) References Cited

U.S. PATENT DOCUMENTS 5,636,539 A * 6/1997 Tsai ..... E05B 37/02 70/30
5,653,136 A * 8/1997 Huang ..... E05B 37/02 70/312
5,899,099 A * 5/1999 Tsai ..... E05B 37/10 70/26
5,934,120 A * 8/1999 Kuo ..... E05B 37/02 70/30
6,209,368 B1 * 4/2001 Lee ..... E05B 37/025 70/30
6,386,005 B1 * 5/2002 Kuo ..... E05B 37/025 70/28
6,422,051 B1 * 7/2002 Kuo ..... E05B 37/02 70/312
6,711,922 B1 * 3/2004 Tsai ..... E05B 37/025 70/30
6,799,445 B1 * 10/2004 Tsai ..... E05B 37/0031 70/284
6,799,446 B1 * 10/2004 Tsai ..... E05B 37/02 70/26
6,845,643 B2 * 1/2005 Tsai ..... E05B 37/0031 70/26
7,337,637 B2 * 3/2008 Kan ..... E05B 37/025 70/30
8,297,087 B1 * 10/2012 Lin ..... E05B 37/0058 70/26

* cited by examiner

*Primary Examiner* — Suzanne Barrett
(74) *Attorney, Agent, or Firm* — Maier & Maier, PLLC

(57) ABSTRACT

A dial wheel device has a controller. The controller has a positioning rod. An adjuster, a dial wheel module, a seat and a restoring element are mounted on the positioning rod. The dial wheel module has multiple dial wheel assemblies. Each dial wheel assembly has an outer ring and an inner ring. In the code-unchanged state, the outer ring and the inner ring are coactive. In the code-changing state, the adjuster is rotated and the guide element forms a lateral displacement to push the inner ring, and the outer ring and the inner ring are non-coactive. The outer ring is turned to reset the code. When the code-changing state is finished, the adjuster is rotated again and the outer ring and the inner ring are coactive again. Therefore, the components of the code-changeable assembly are simplified and the dial wheel device is easy to assemble and operate.

14 Claims, 15 Drawing Sheets

CODE-CHANGEABLE ASSEMBLY AND DIAL WHEEL DEVICE

BACKGROUND OF THE INVENTION

1. Field of the Invention

The present invention relates to a code-changeable assembly and a dial wheel device, and more particularly to a code-changeable assembly and a dial wheel device for a combination lock.

2. Description of Related Art

A conventional dial wheel device has a seat, a positioning rod, a restoring element, multiple dial wheel assemblies, and an adjuster. The seat has a first side surface. The positioning rod is mounted on the first side surface of the seat and has a through recess. The restoring element is mounted on the positioning rod and is connected to the first side surface of the seat. The dial wheel assemblies are connected with each other and are mounted on the positioning rod. One of the dial wheel assemblies facing the first side surface of the seat is connected to the restoring element. The adjuster is mounted on an end of the positioning rod and is connected to one of the dial wheel assemblies close to the end of the positioning rod. Each dial wheel assembly has an outer ring, a retaining element, a pushing element and a torsion spring. The outer ring has a retaining recess. The retaining element is mounted in the outer ring and has a retaining portion. The retaining portion is inserted into the retaining recess of the outer ring selectively. The pushing element is mounted in the outer ring and abuts the retaining element. The torsion spring is mounted on the pushing element.

In the code-unchanged state, the retaining portion of the retaining element is inserted into the retaining recess of the outer ring, and the retaining element and the outer ring are coactive. In the code-changing state, the adjuster is controlled to push the retaining element, the pushing element and the torsion spring in the outer ring. The retaining portion of the retaining element is moved out from the retaining recess of the outer ring, and the retaining element and the outer ring are non-coactive. Then, users turn the outer ring to select one of the code combinations on the outer ring, and then the adjuster is controlled. The retaining element is inserted into the retaining recess of the outer ring again, and the retaining element and the outer ring are coactive again.

As such, each dial wheel assembly of the dial wheel device has many components and is inconvenient in assembly.

To overcome the shortcomings, the present invention tends to provide a code-changeable assembly and a dial wheel device to mitigate or obviate the aforementioned problems.

SUMMARY OF THE INVENTION

The main objective of the invention is to provide a code-changeable assembly and a dial wheel device being easy to assemble.

The code-changeable assembly has a controller and a dial wheel assembly. The dial wheel assembly is mounted on the controller and has an outer ring, an inner ring and a torsion spring. The outer ring has multiple retaining grooves formed in an inner surface of the outer ring. The inner ring is controlled by the controller and located in the outer ring, and has a retaining portion and a positioning recess. The retaining portion is mounted on an outer surface of the inner ring. The positioning recess is formed in an inner surface of the inner ring. The torsion spring is mounted on the inner ring and connected to the controller.

The dial wheel device has a controller, a dial wheel module, a seat and a restoring element. The controller has a positioning rod and an adjuster. The positioning rod has a plate, a locking hole, a first chute, a rod body, a slot and multiple positioning elements. The locking hole is formed through the plate. The first chute is formed in the plate. The rod body is formed on the plate. The slot is formed in the rod body and is in communication with the locking hole. The positioning elements are mounted on an outer surface of the rod body. The adjuster is rotatably mounted on the rod body of the positioning rod and has two shafts and a guide element. The shafts protrude out from the plate. The guide element is inserted into the first chute. The dial wheel module is mounted on the rod body of the controller and is connected to the adjuster. The dial wheel module has multiple dial wheel assemblies and each dial wheel assembly has an outer ring, an inner ring and a torsion spring. The outer ring has multiple retaining grooves formed in an inner surface of the outer ring. The inner ring is located in the outer ring and has a retaining portion and a positioning recess. The retaining portion is mounted on an outer surface of the inner ring and is selectively inserted into one of the retaining grooves of the outer ring. The positioning recess is formed in an inner surface of the inner ring and each positioning element is inserted into a corresponding one of the positioning recesses of the dial wheel assemblies. The torsion spring is mounted on the inner ring and is connected to the rod body. The seat is mounted on a distal end of the rod body of the positioning rod. The restoring element is mounted on the rod body of the positioning rod, and two ends of the restoring element are connected to the dial wheel module and the seat respectively.

In the code-unchanged state, the retaining portion of the inner ring is inserted in one of the retaining grooves, and the outer ring and the inner ring are coactive. In the code-changing state, the adjuster is rotated and the guide element is moved along the first chute for forming a lateral displacement to push the inner ring. Thus, the retaining portion of the inner ring is moved out from the corresponding one of the retaining grooves of the outer ring, and the outer ring and the inner ring are non-coactive. Then, users can turn the outer ring to reset the code. When the code-changing state is finished, the adjuster is rotated again and the outer ring and the inner ring are coactive again. Therefore, the components of the code-changeable assembly are simplified and the dial wheel device is easy to assemble and operate.

DETAILED DESCRIPTION OF PREFERRED EMBODIMENT

Figure 1:
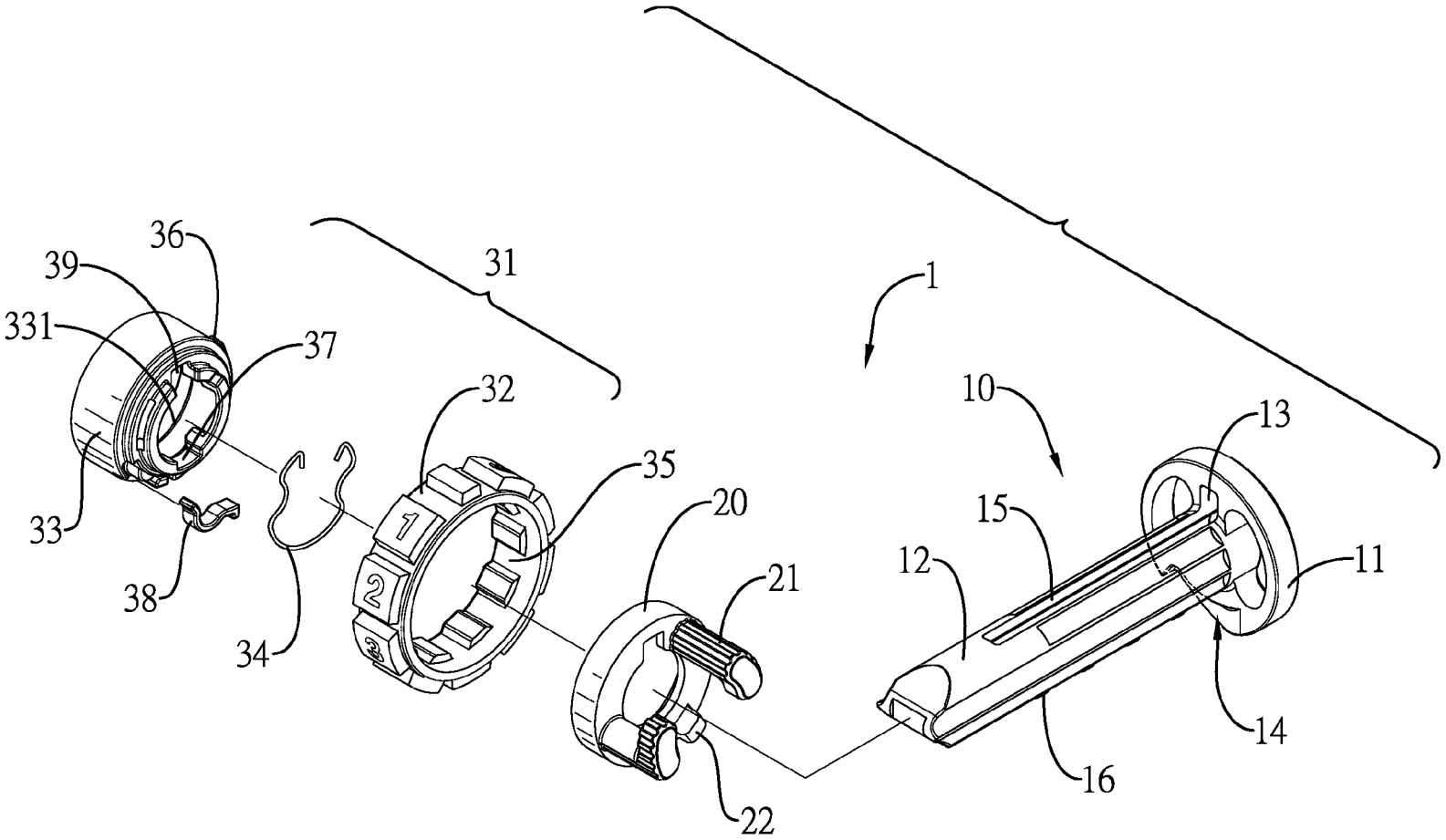
FIG. 1 is an exploded perspective view of a code-changeable assembly in accordance with the present invention.
Figure 2:
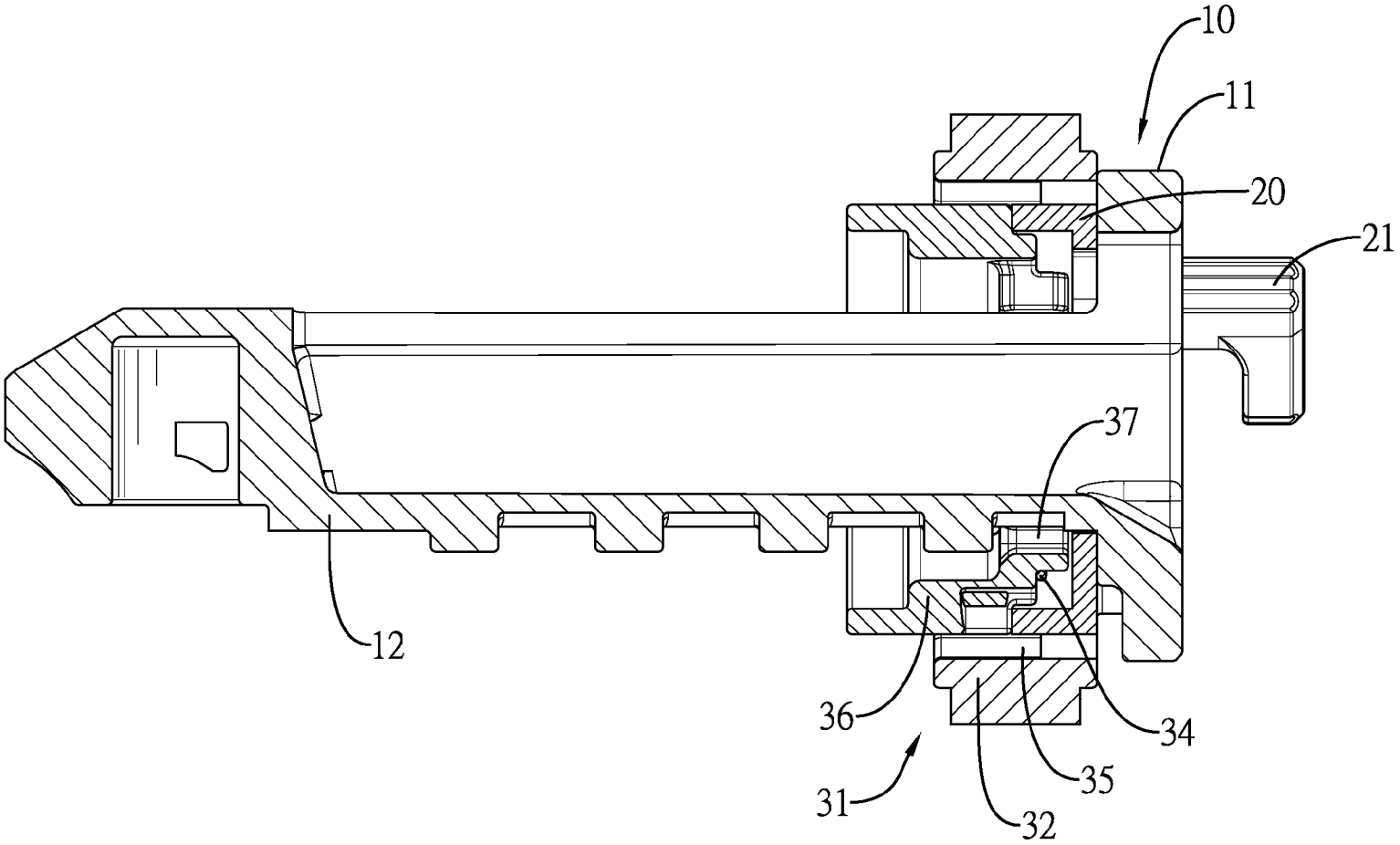
FIG. 2 is a side view in partial section of the code-changeable assembly in FIG. 1.

With reference to FIGS. 1 and 2, a code-changeable assembly in accordance with the present invention comprises a controller 1 and a dial wheel assembly 31.

The controller 1 has a positioning rod 10 and an adjuster 20. The positioning rod 10 has a plate 11, a locking hole 13, a first chute 14, a rod body 12, a slot 15 and multiple positioning elements 16. The locking hole 13 is formed through the plate 11. The first chute 14 is formed in the plate 11. The rod body 12 is formed on plate 11. The slot 15 is formed in the rod body 12 and is in communication with the locking hole 13. The positioning elements 16 are mounted on an outer surface of the rod body 12. The adjuster 20 is rotatably mounted on the rod body 12 of the positioning rod 10. The adjuster 20 has two shafts 21 and a guide element 22. The shafts 21 protrude out from the plate 11. The guide element 22 is inserted into the first chute 14.

The dial wheel assembly 31 is mounted on the controller 1 and has an outer ring 32, an inner ring 33 and a torsion spring 34. The outer ring 32 has multiple retaining grooves 35 formed in an inner surface of the outer ring 32. The inner ring 33 is controlled by the controller 1 and is located in the outer ring 32, and has a retaining portion 36, a retaining surface 331, a positioning recess 37 and a notch 39. The retaining portion 36 is formed on an outer surface of the inner ring 33. The positioning recess 37 is formed in an inner surface of the inner ring 33. The notch 39 is formed in the inner surface of the inner ring 33 and is diametrically opposite to the positioning recess 37. The retaining surface 331 is formed on the inner surface of the inner ring 33 except at positions where the notch 39 and the positioning recess 37 are formed, and selectively abuts one of the positioning elements 16. The torsion spring 34 is mounted on the inner ring 33 and is connected to the rod body 12 of the controller 1.

Figure 9:
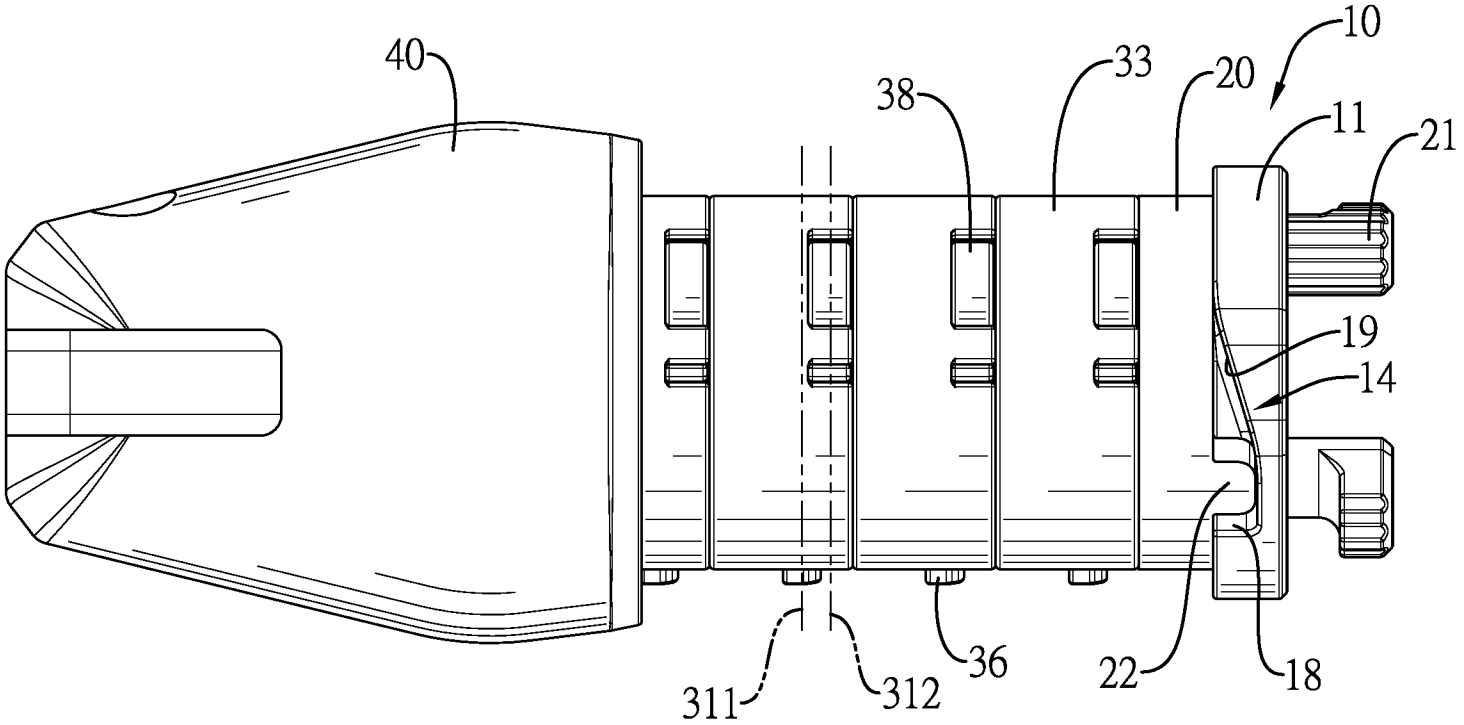
FIG. 9 is a bottom side view of the dial wheel device in FIG. 4 shown without the outer rings.

With further reference to FIG. 9, the dial wheel assembly 31 has a first base plane 311, a second base plane 312 and an elastic piece 38. The first base plane 311 is an imaginary plane that extends radially through the dial wheel assembly 31 and is perpendicular to the outer surface of the inner ring 33, and the retaining portion 36 is located at the first base plane 311. The second base plane 312 is an imaginary plane that extends radially through the dial wheel assembly 31, is perpendicular to the outer surface of the inner ring 33, and is parallel with the first base plane 311. With reference to FIGS. 2 and 9, the elastic piece 38 is mounted on the inner ring 33 and is selectively inserted into one of the retaining grooves 35 of the outer ring 32, and the elastic piece 38 is located at the second base plane 312.

Figure 3:
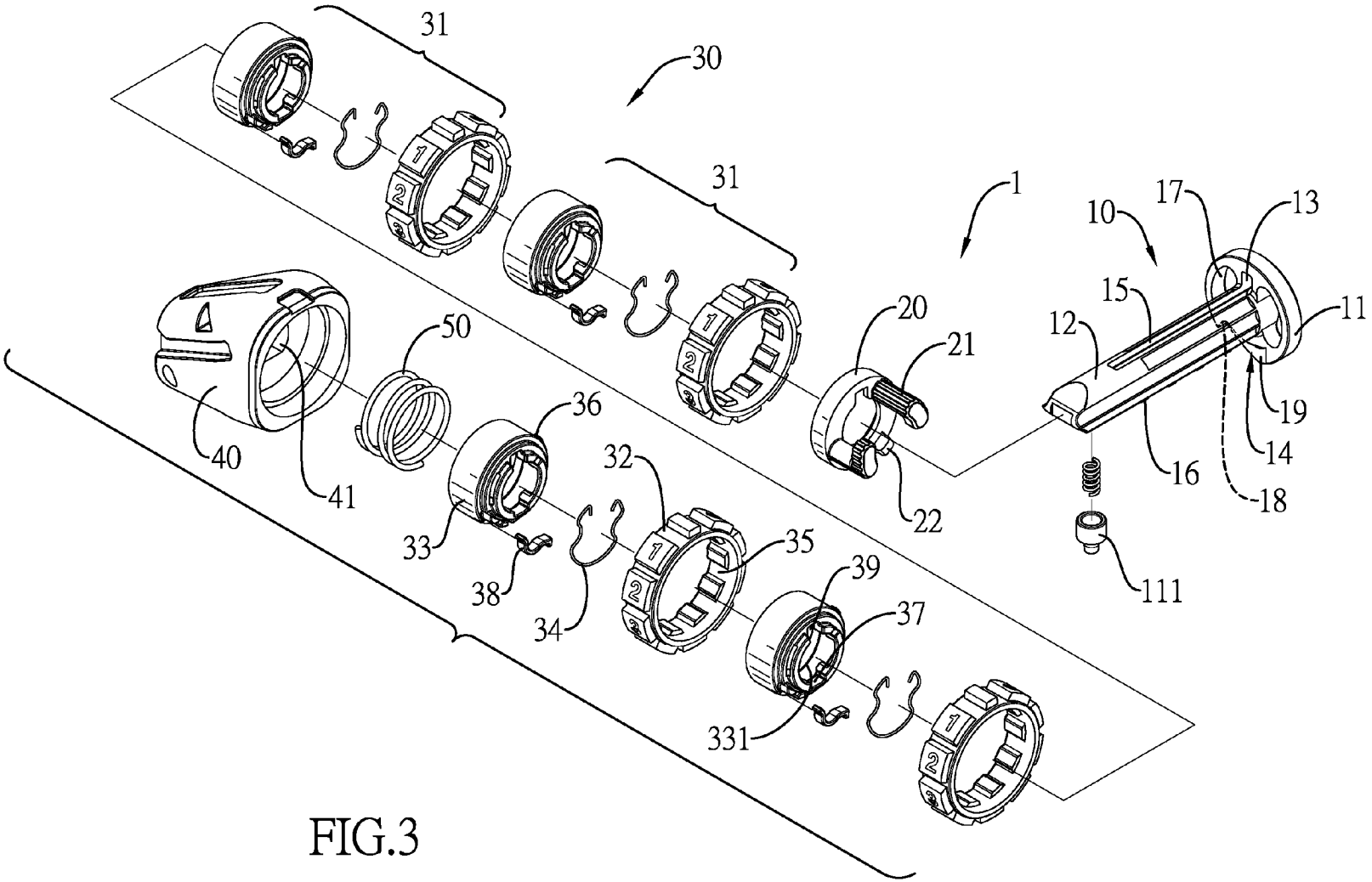
FIG. 3 is an exploded perspective view of a dial wheel device in accordance with the present invention.
Figure 4:
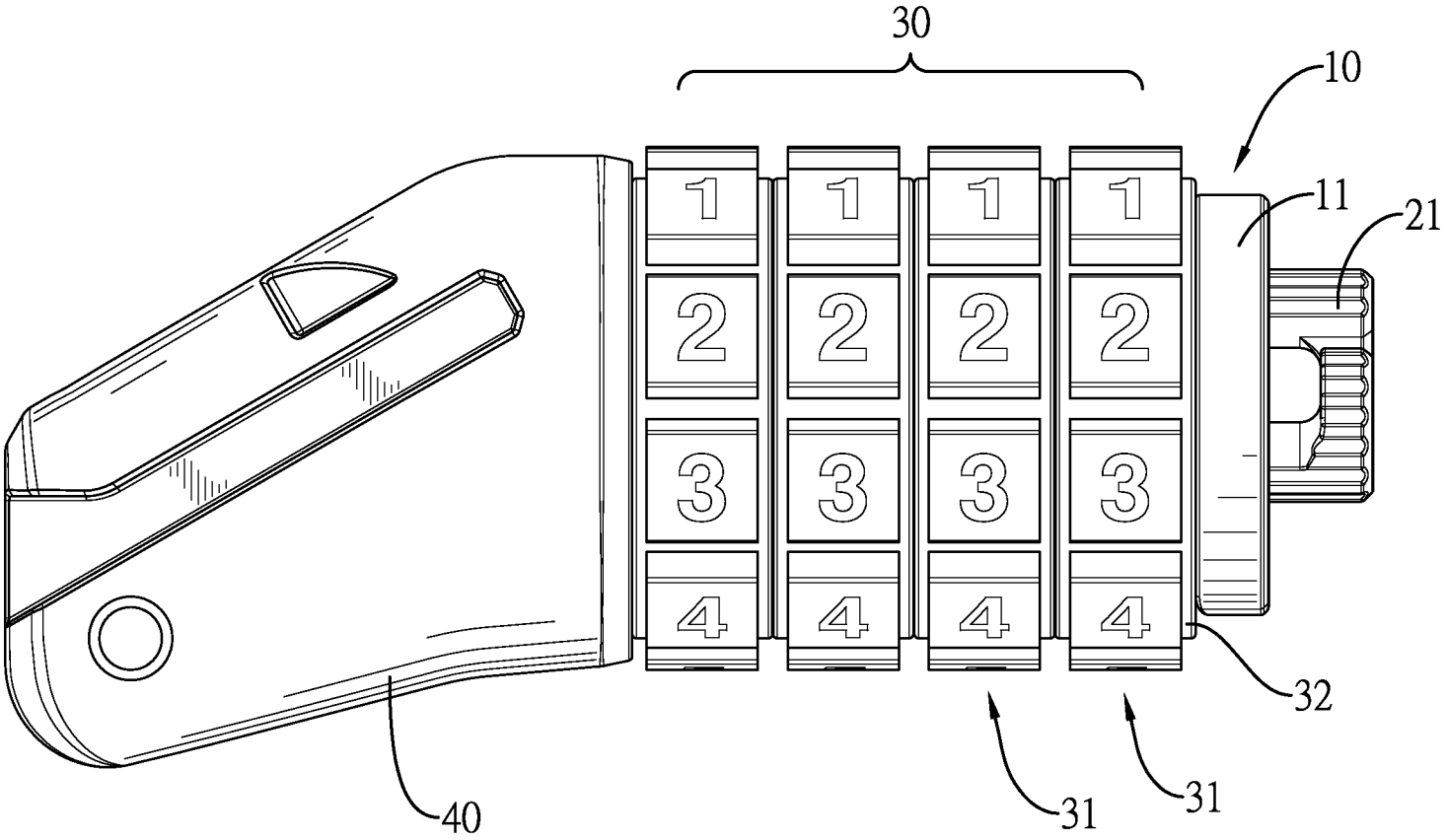
FIG. 4 is an enlarged side view of the dial wheel device in FIG. 3.
Figure 5:
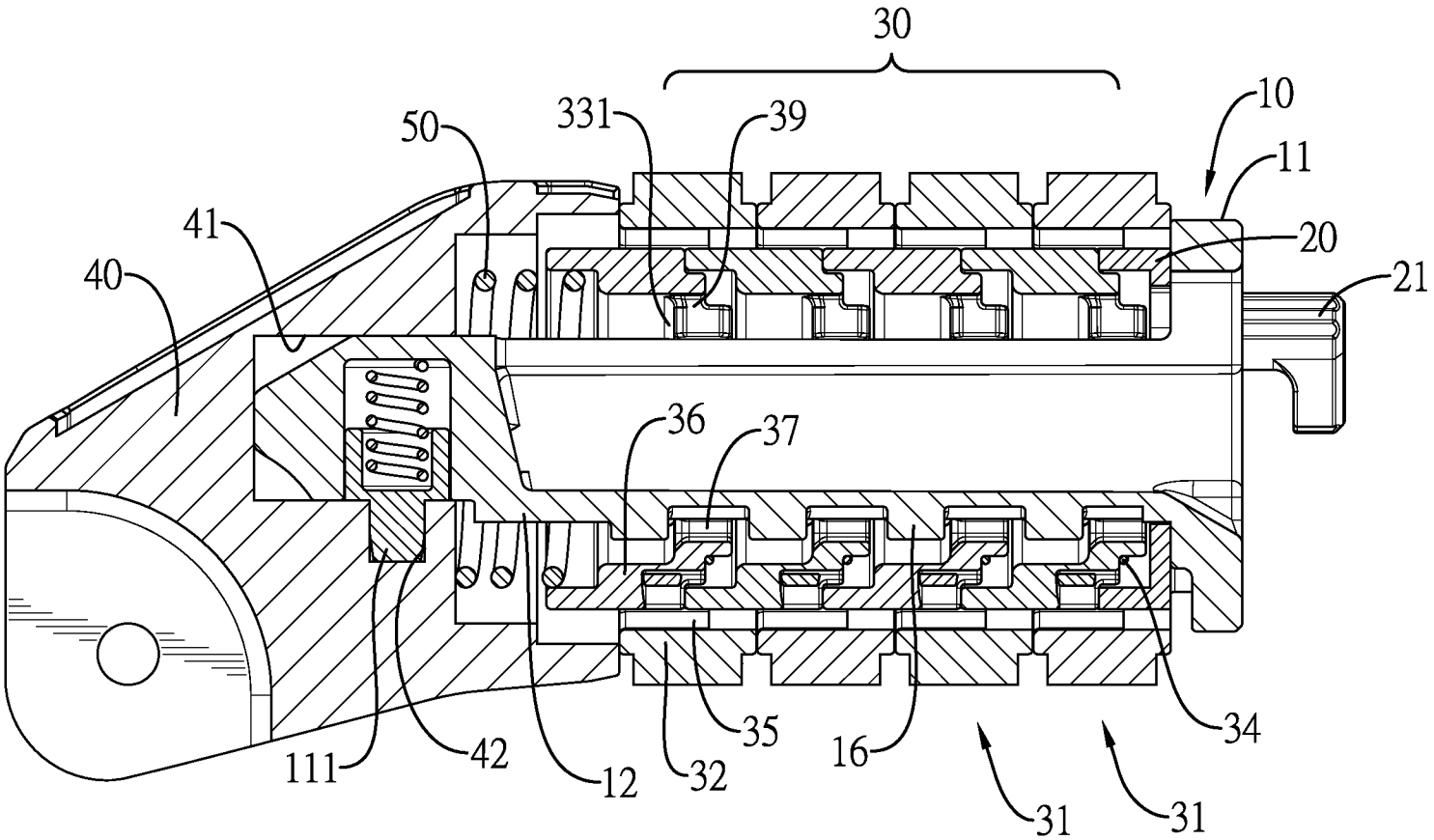
FIG. 5 is a side view in partial section of the dial wheel device in FIG. 4.

With reference to FIGS. 3 to 5, a dial wheel device in accordance with the present invention comprises the controller 1 as aforementioned, a dial wheel module 30, a seat 40 and a restoring element 50.

The dial wheel module 30 is mounted on the rod body 12 of the controller 1 and is connected to the adjuster 20. The dial wheel module 30 has multiple dial wheel assemblies 31 as aforementioned. The retaining portion 36 of each dial wheel assembly 31 is selectively inserted into one of the retaining grooves 35 of the outer ring 32. Each positioning element 16 is inserted into a corresponding one of the positioning recesses 37 of the dial wheel assemblies 31.

The seat 40 is mounted on a distal end of the rod body 12 of the positioning rod 10.

The restoring element 50 is mounted around the rod body 12 of the positioning rod 10, and two ends of the restoring element 50 are connected to the dial wheel module 30 and the seat 40 respectively.

The seat 40 has an assembly hole 41 and a pin hole 42. The assembly hole 41 is formed in a surface of the seat 40 facing the dial wheel assemblies 31. The pin hole 42 is formed in the seat 40 and is laterally in communication with the assembly hole 41. The positioning rod 10 has a positioning pin 111. The positioning pin 111 is retractable and is mounted on the distal end of the rod body 12. When the distal end of the rod body 12 is inserted into the assembly hole 41 of the seat 40, the positioning pin 111 is inserted into the pin hole 42 of the seat 40. The positioning rod 10 has two second chutes 17 formed through the plate 11, and each shaft 21 protrudes out from a corresponding one of the second chutes 17 of the positioning rod 10. The first chute 14 is formed in an inner surface of the plate 11 and has a positioning surface 18 and a guide surface 19. The guide surface 19 is formed in and is inclined relative to the inner surface of the plate 11. The positioning surface 18 is located at an end of the guide surface 19.

Figure 6:
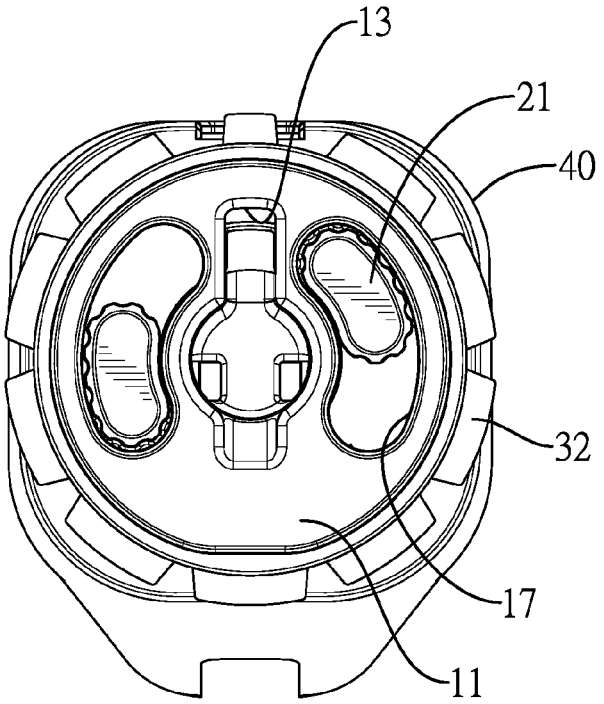
FIG. 6 is a rear side view of the dial wheel device in FIG. 4 in the code-unchanged state.
Figure 8:
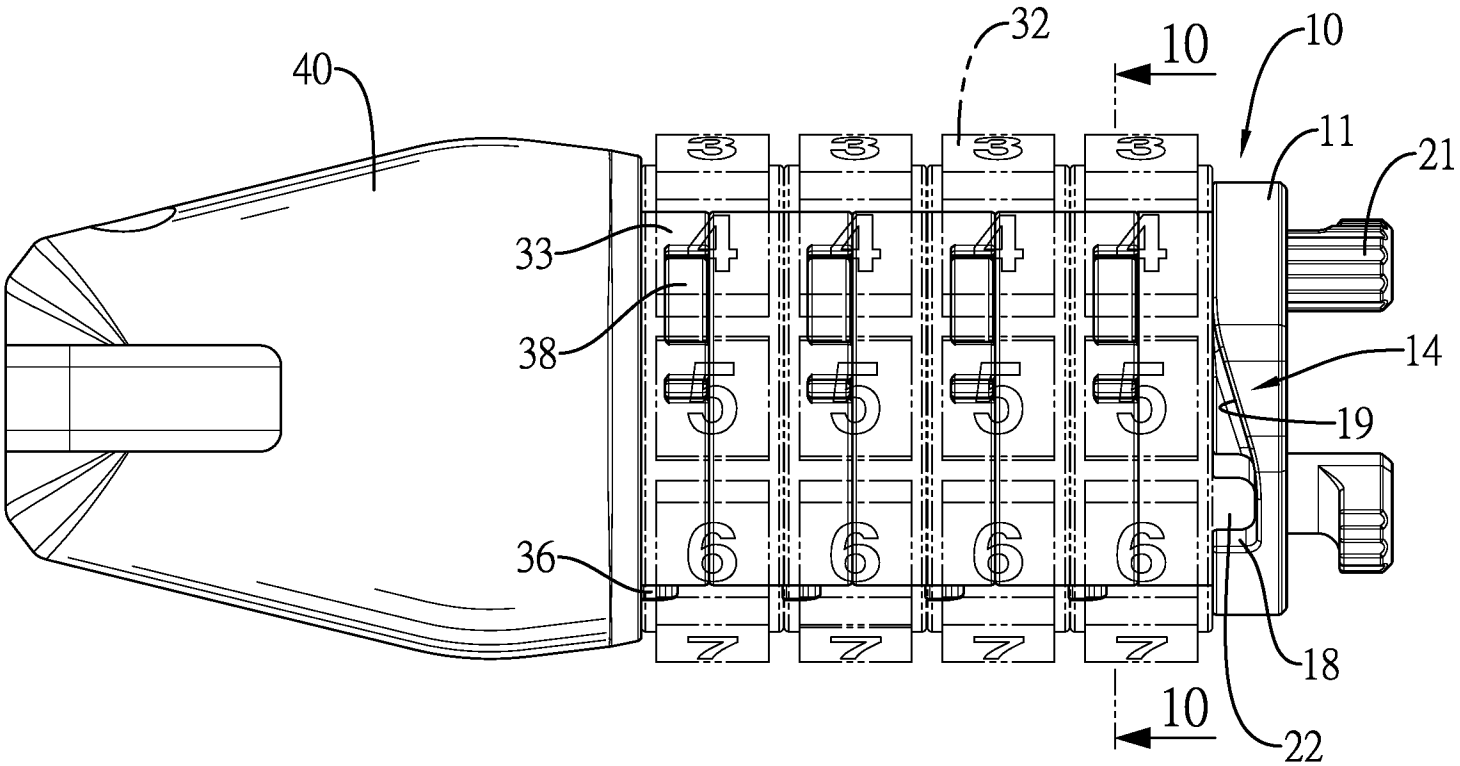
FIG. 8 is a bottom side view of the dial wheel device in FIG. 4 in the code-unchanged state.
Figure 10:
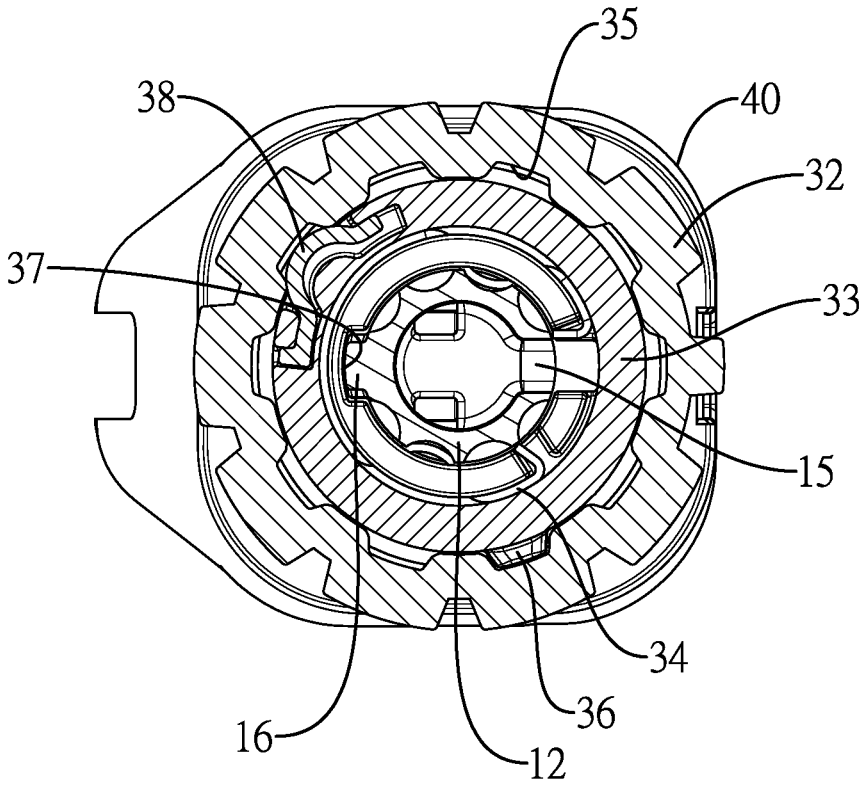
FIG. 10 is a side view in partial section of the dial wheel device along line 10-10 in FIG. 8.

With reference to FIGS. 6, 8 and 9, in the code-unchanged state, the guide element 22 of the adjuster 20 is inserted into the first chute 14 and abuts the positioning surface 18. With further reference to FIGS. 8 and 10, in each dial wheel assembly 31, the retaining portion 36 of the inner ring 33 is inserted into one of the retaining grooves 35 of the outer ring 32, and the outer ring 32 and the inner ring 33 are coactive.

Figure 7:
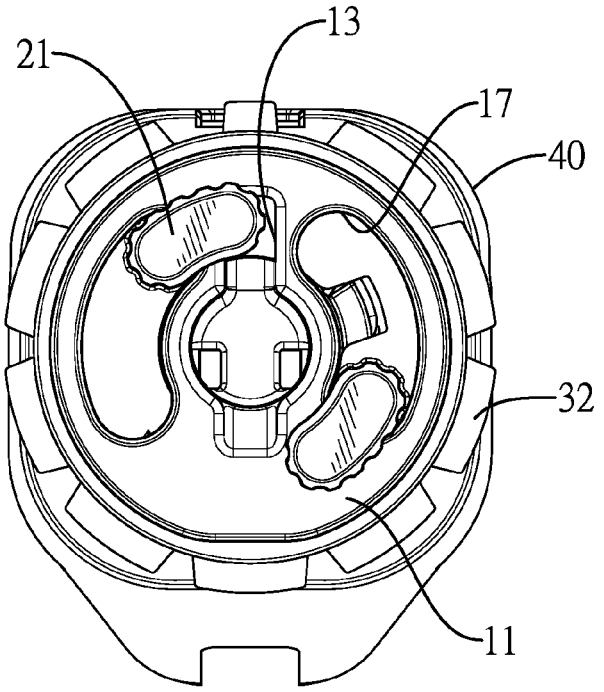
FIG. 7 is a rear side view of the dial wheel device in FIG. 4 in the code-changing state.
Figure 11:
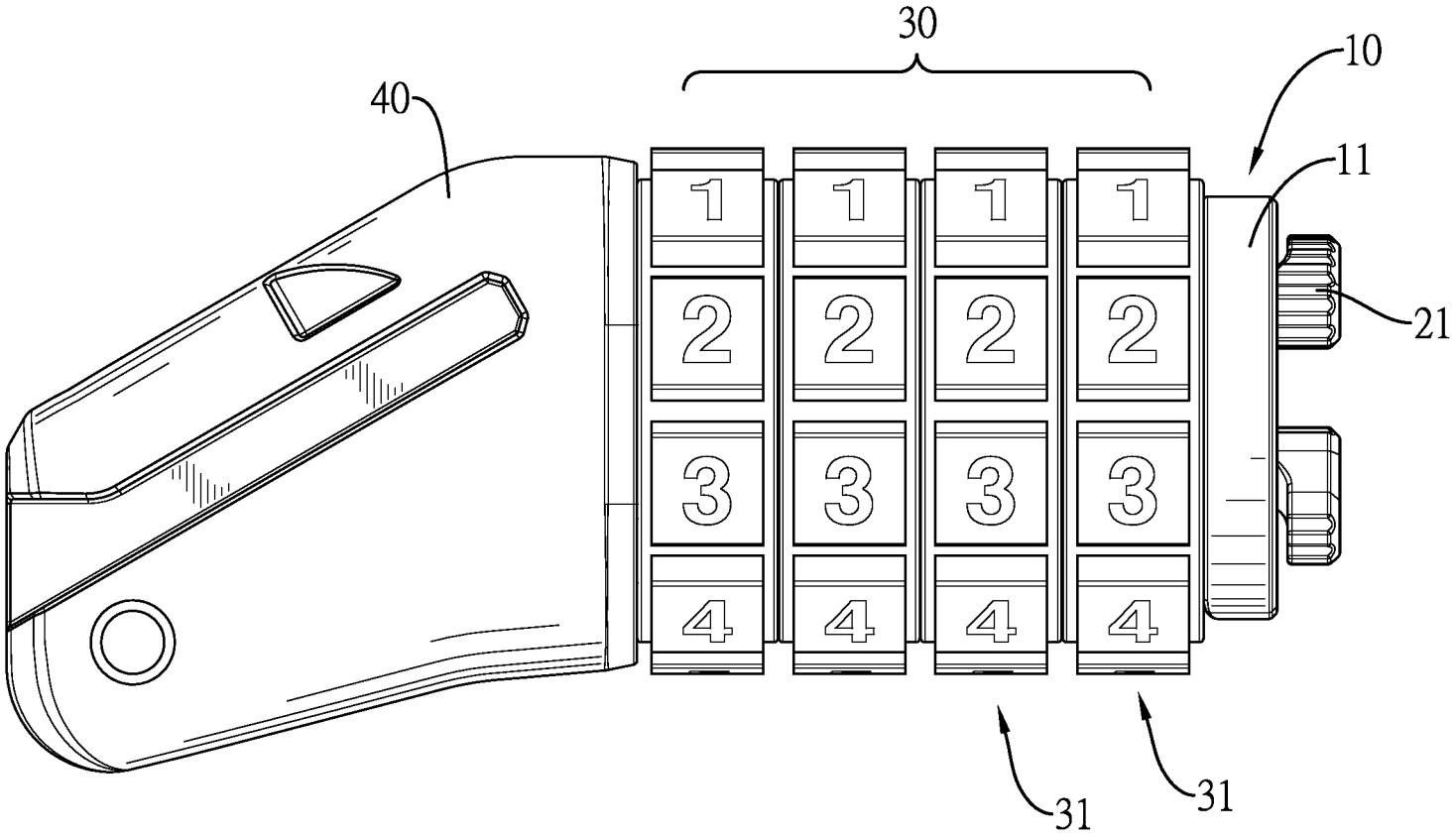
FIG. 11 is a side view of the dial wheel device in FIG. 4 in the code-changing state.
Figure 12:
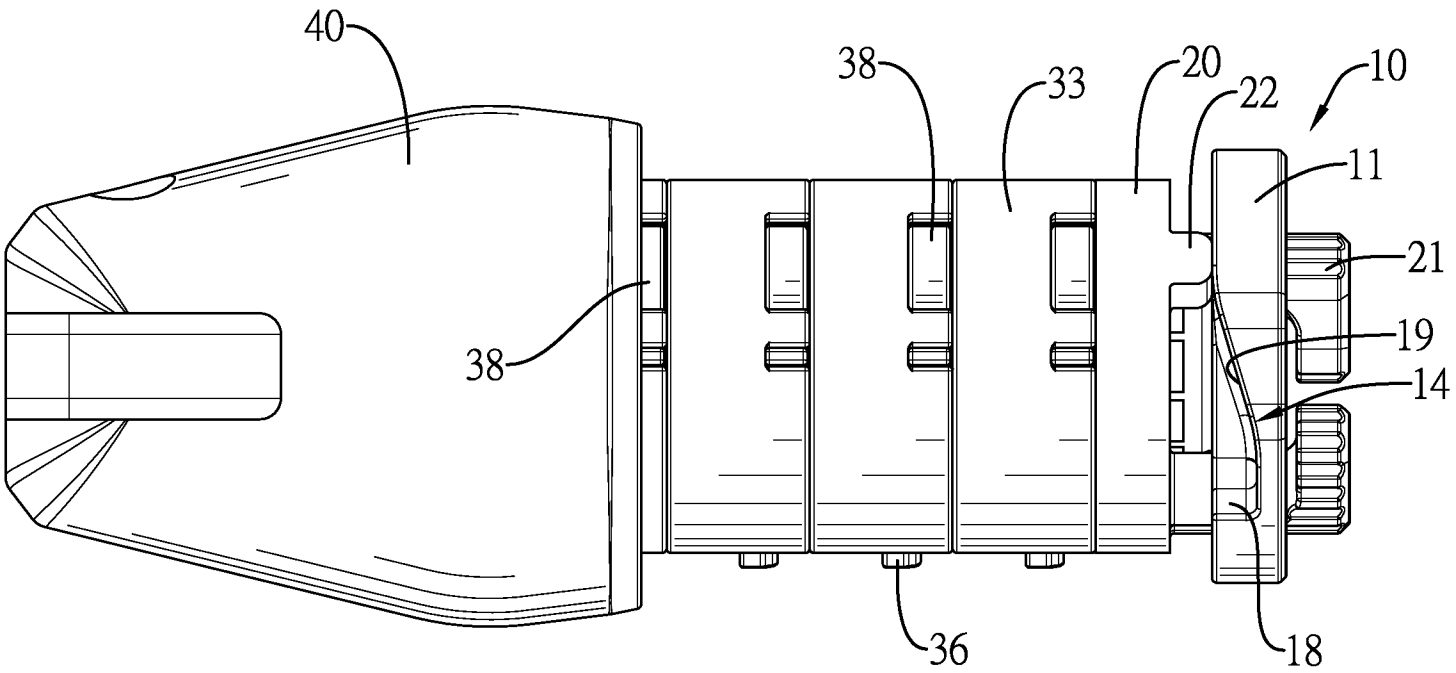
FIG. 12 is a bottom view of the dial wheel device in FIG. 4 in the code-changing state and shown without the outer rings.
Figure 13:
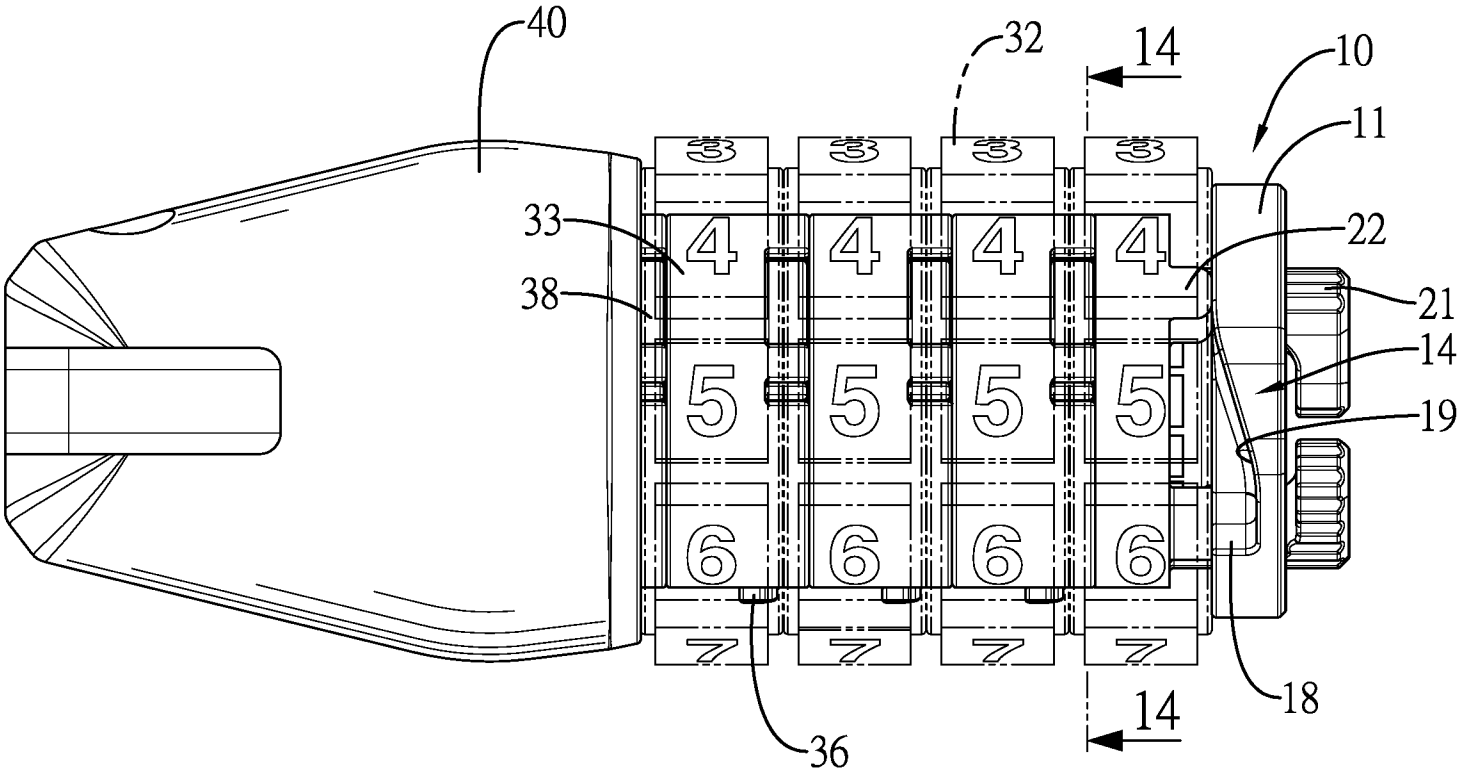
FIG. 13 is a bottom view of the dial wheel device in FIG. 4 in the code-changing state.
Figure 14:
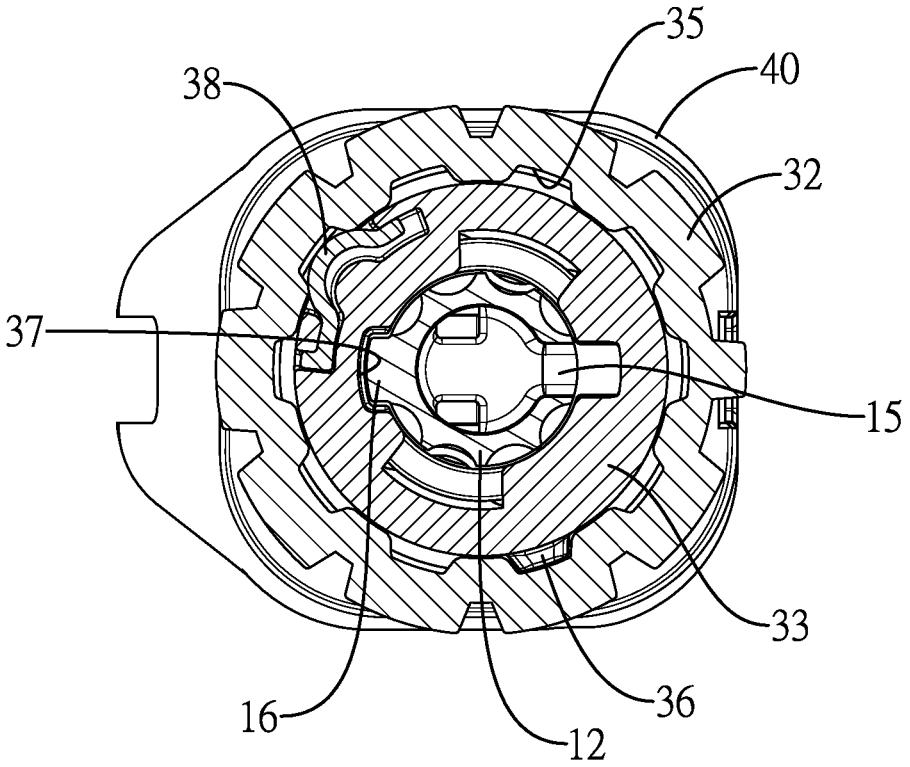
FIG. 14 is a side view in partial section of the dial wheel device along line 14-14 in FIG. 13.

Before changing the code, the positioning recesses 37 of the inner rings 33 are rotated to align with the positioning elements 16, and the retaining surfaces 331 of the inner rings 33 are kept from abutting the positioning elements 16. With reference to FIGS. 7, 11 and 13, in the code-changing state, the adjuster 20 is rotated and the shafts 21 of the adjuster 20 are moved along the second chutes 17 of the positioning rod 10. The guide element 22 of the adjuster 20 is moved along the guide surface 19 of the first chute 14 to the inner surface of the plate 11 for pushing the inner ring 33 to move axially, and the positioning recess 37 of the inner ring 33 is moved to hold a corresponding one of the positioning elements 16 inside. With reference to FIGS. 13 and 14, in each dial wheel assembly 31, the retaining portion 36 of the inner ring 33 is moved out from a corresponding one of the retaining grooves 35 of the outer ring 32. The outer ring 32 and the inner ring 33 are non-coactive. Then, the outer ring 32 is turned to reset the code. When the code-changing state is finished, the adjuster 20 is rotated again, and the guide element 22 of the adjuster 20 is moved into the first chute 14 and abuts the positioning surface 18. The restoring element 50 pushes the inner ring 33. In each dial wheel assembly 31, the retaining portion 36 of the inner ring 33 is inserted into one of the retaining grooves 35 of the outer ring 32, and the outer ring 32 and the inner ring 33 are coactive again.

With reference to FIG. 14, the elastic piece 38 of the dial wheel assembly 31 is inserted into one of the retaining grooves 35 of the outer ring 32. In the code-changing state, the outer ring 32 is turned to shift the retaining groove 35 that the elastic piece 38 is inserted into. The rotating process of the outer ring 32 generates a tactile indication of the positioning effect to the user's hand.

Figure 15:
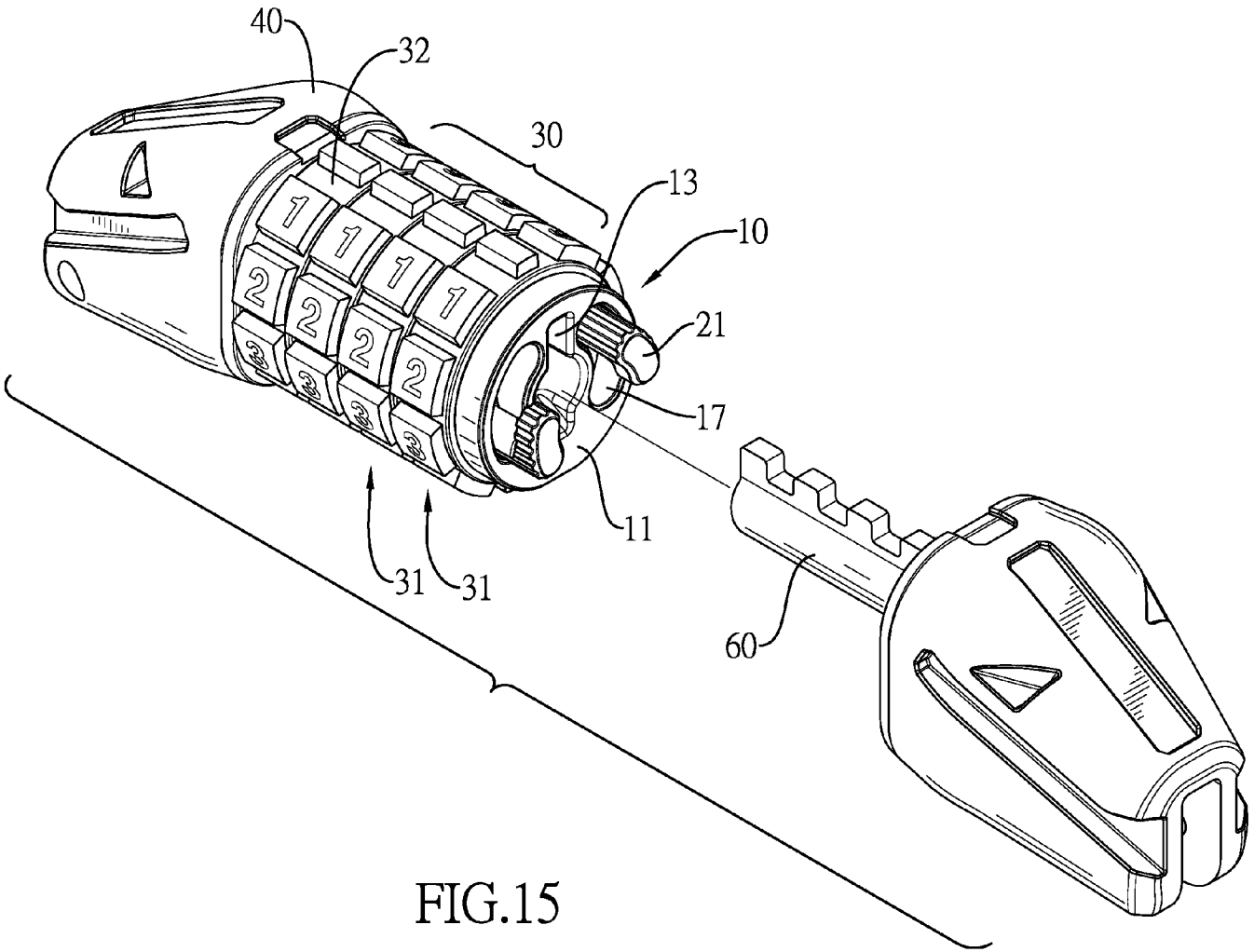
FIG. 15 is an operational perspective view of the dial wheel device in FIG. 4 shown with a locking bar.
Figure 16:
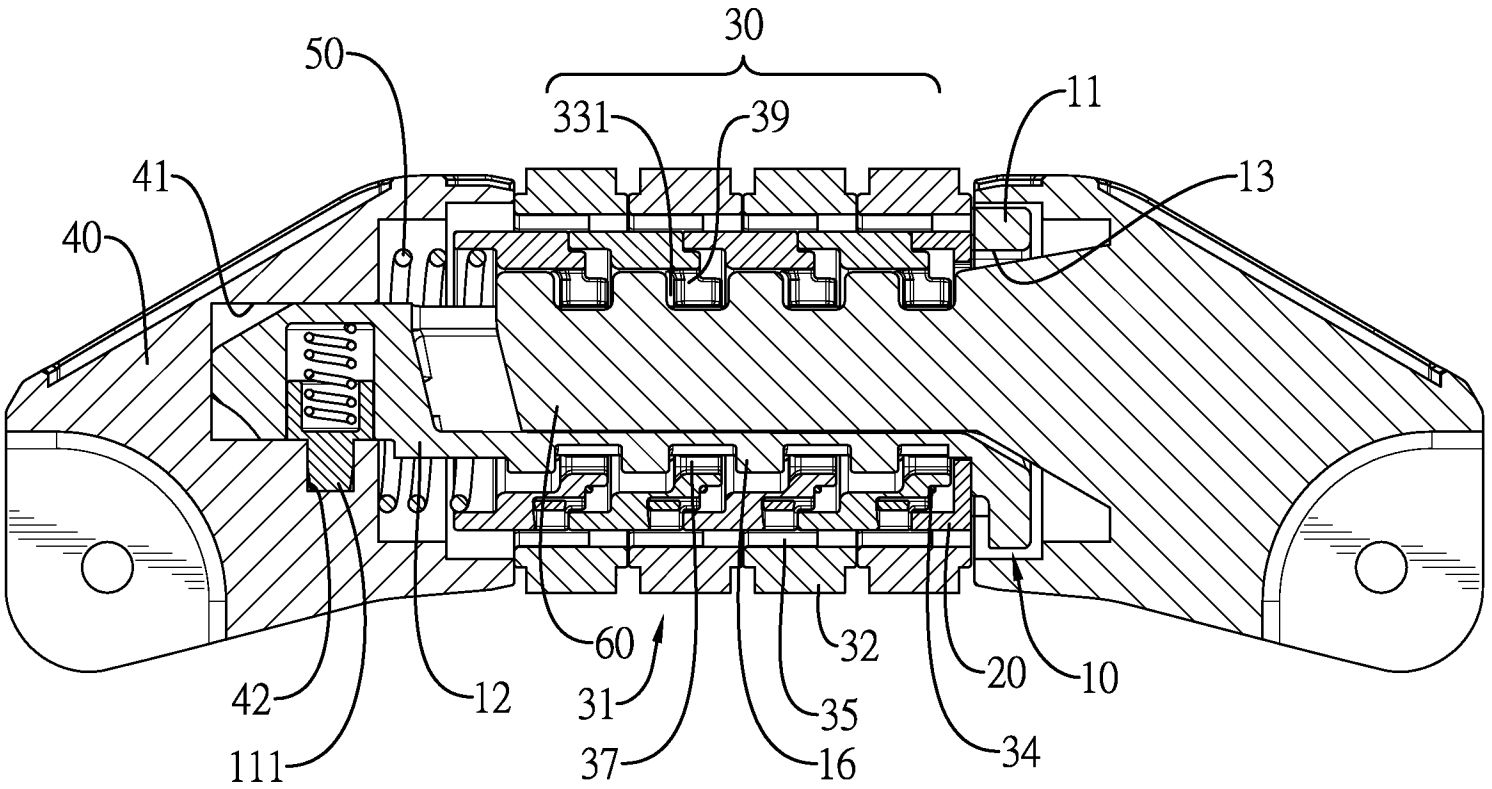
FIG. 16 is an operational side view in partial section of the dial wheel device in FIG. 4 shown with a locking bar.

The locking bar has multiple teeth. With reference to FIGS. 15 and 16, in the unlocked state of the dial wheel device, the notches 39 of the inner rings 33 are aligned with each other and face the slot 15 of the positioning rod 10. Therefore, the locking bar 60 can be inserted into or removed out of the dial wheel device.

The locking bar 60 is inserted into the locking hole 13 of the positioning rod 10 and the teeth of the locking bar 60 protrude out of the slot 15 of the rod body 12. In the locked state of the dial wheel device, the notches 39 of the inner rings 33 do not face the slot 15 of the positioning rod 10, and the teeth of the locking bar 60 are stopped by the retaining surfaces 331 of the inner rings 33. Therefore, the locking bar 60 cannot be removed out of the dial wheel device. Accordingly, the adjuster 20 pushes the inner ring 33 in the code-unchanged state, and the retaining portion 36 of the inner ring 33 is moved out from a corresponding one of the retaining grooves 35 of the outer ring 32. Therefore, the outer ring 32 and the inner ring 33 are non-coactive. After resetting of the code is finished, the outer ring 32 and the inner ring 33 are coactive. Thus, the components of the code-changeable assembly 31 are simplified and the dial wheel device is easy to assemble and operate.

In addition, the elastic piece 38 is mounted on the inner ring 33 and is located at the second base plane 312. When the retaining portion 36 of the inner ring 33 is moved out from a corresponding one of the retaining grooves 35 of the outer ring 32, the elastic piece 38 is still inserted in one of the retaining grooves 35. Therefore, the rotating process of the outer ring 32 generates a tactile indication of the positioning effect.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A code-changeable assembly comprising:
- a controller having
  - a positioning rod having
    - a plate;
    - a locking hole formed through the plate;
    - a first chute formed in the plate;
    - a rod body formed on the plate;
    - a slot formed in the rod body and communicating with the locking hole;
    - multiple positioning elements mounted on an outer surface of the rod body; and
  - an adjuster rotatably mounted on the rod body of the positioning rod and having
    - two shafts protruding out from the plate; and
    - a guide element inserted into the first chute; and
- a dial wheel assembly mounted on the controller, the rod body of the controller inserted through the dial wheel assembly, and the dial wheel assembly and having
- an outer ring having
  - multiple retaining grooves formed in an inner surface of the outer ring;
- an inner ring controlled by the controller and located in the outer ring, and having
  - a retaining portion mounted on an outer surface of the inner ring; and
  - a positioning recess formed in an inner surface of the inner ring, and the positioning elements of the controller selectively inserted into the positioning recess; and
  - a torsion spring mounted on the inner ring and connected to the controller.

2. The code-changeable assembly as claimed in claim 1, wherein
- the dial wheel assembly has
  - a first base plane being perpendicular to the outer surface of the inner ring, wherein the retaining portion is located at the first base plane;
  - a second base plane being perpendicular to the outer surface of the inner ring and parallel with the first base plane; and
  - an elastic piece mounted on the inner ring and selectively inserted into one of the retaining grooves of the outer ring, and the elastic piece located at the second base plane.

3. A dial wheel device comprising:
- a controller having
  - a positioning rod having
    - a plate;
    - a locking hole formed through the plate;
    - a first chute formed in the plate;
    - a rod body formed on the plate;
    - a slot formed in the rod body and communicating with the locking hole;
    - multiple positioning elements mounted on an outer surface of the rod body; and
    - an adjuster rotatably mounted on the rod body of the positioning rod and having
    - two shafts protruding out from the plate; and
    - a guide element inserted into the first chute;
- a dial wheel module mounted on the rod body of the controller and connected to the adjuster and having
  - multiple dial wheel assemblies and each dial wheel assembly having
    - an outer ring having
    - multiple retaining grooves formed in an inner surface of the outer ring;
  - an inner ring located in the outer ring, and having
    - a retaining portion mounted on an outer surface of the inner ring and selectively inserted into one of the retaining grooves of the outer ring; and
    - a positioning recess formed in an inner surface of the inner ring; and
  - a torsion spring mounted on the inner ring and connected to the rod body;
- a seat mounted on a distal end of the rod body of the positioning rod;
- a restoring element mounted on the rod body of the positioning rod and two ends of the restoring element connected to the dial wheel module and the seat respectively; and wherein each one of the positioning elements is inserted into the positioning recess of each one of the dial wheel assemblies.

4. The dial wheel device as claimed in claim 3, wherein the dial wheel assembly has a first base plane being perpendicular to the outer surface of the inner ring, wherein the retaining portion is located at the first base plane;

a second base plane being perpendicular to the outer surface of the inner ring and parallel with the first base plane; and an elastic piece mounted on the inner ring and selectively inserted into one of the retaining grooves of the outer ring, and the elastic piece located at the second base plane.

5. The dial wheel device as claimed in claim 4, wherein the positioning rod has two second chutes disposed through the plate, and each shaft protrudes out of a corresponding one of the second chutes of the positioning rod.

6. The dial wheel device as claimed in claim 3, wherein the seat has an assembly hole; and a pin hole laterally communicating with the assembly hole;

the positioning rod has a positioning pin being retractable and mounted on the distal end of the rod body, the distal end of the rod body inserted into the assembly hole of the seat, and the positioning pin inserted into the pin hole of the seat.

7. The dial wheel device as claimed in claim 4, wherein the seat has an assembly hole; and a pin hole laterally communicating with the assembly hole; and the positioning rod has a positioning pin being retractable and mounted on the distal end of the rod body, the distal end of the rod body inserted into the assembly hole of the seat, and the positioning pin inserted into the pin hole of the seat.

8. The dial wheel device as claimed in claim 5, wherein the seat has an assembly hole; and a pin hole laterally communicating with the assembly hole; and the positioning rod has a positioning pin being retractable and mounted on the distal end of the rod body, the distal end of the rod body inserted into the assembly hole of the seat, and the positioning pin inserted into the pin hole of the seat.

9. The dial wheel device as claimed in claim 3, wherein the first chute has a guide surface formed on and inclined relative to an inner surface of the plate; and a positioning surface located at an end of the guide surface.

10. The dial wheel device as claimed in claim 4, wherein the first chute has a guide surface formed on and inclined relative to an inner surface of the plate; and a positioning surface located at an end of the guide surface.

11. The dial wheel device as claimed in claim 5, wherein the first chute has a guide surface formed on and inclined relative to an inner surface of the plate; and a positioning surface located at an end of the guide surface.

12. The dial wheel device as claimed in claim 6, wherein the first chute has a guide surface formed on and inclined relative to an inner surface of the plate; and a positioning surface located at an end of the guide surface.

13. The dial wheel device as claimed in claim 7, wherein the first chute has a guide surface formed on and inclined relative to an inner surface of the plate; and a positioning surface located at an end of the guide surface.

14. The dial wheel device as claimed in claim 8, wherein the first chute has a guide surface formed on and inclined relative to an inner surface of the plate; and a positioning surface located at an end of the guide surface.

* * * * *